US006168289B1

(12) United States Patent
Shah

(10) Patent No.: US 6,168,289 B1
(45) **Date of Patent: *Jan. 2, 2001**

(54) STRAIGHT FLUORESCENT TUBE THAT HAS AN ELECTRONIC BALLAST HOUSED IN THE SOCKETS ON BOTH SIDES

(76) Inventor: Suresh H. Shah, 215 Shatikuteer Marine Drive, Nelaji Subhash Road, Mumbal 400 020, Mabarashtra (IN)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/262,443

(22) Filed: Mar. 4, 1999

(30) Foreign Application Priority Data

Jan. 12, 1999 (DE) ..... 199 00 888

(51) Int. Cl.[7] ..... F21S 4/00

(52) U.S. Cl. ..... 362/221; 362/217; 362/222; 362/260; 362/263; 362/265; 313/331; 313/49

(58) Field of Search ..... 362/217, 221, 362/222, 260, 263, 265; 313/331, 491, 493, 623, 567

(56) References Cited

U.S. PATENT DOCUMENTS 3,953,761 * 4/1976 Giudice ..... 315/71
4,495,443 * 1/1985 Cummings ..... 315/58
5,086,249 * 2/1992 Blaisdell et al. ..... 313/318

FOREIGN PATENT DOCUMENTS 195 12 307 A1 * 10/1996 (DE) .

* cited by examiner

*Primary Examiner*—Sandra O'Shea
*Assistant Examiner*—Ismael Negron
(74) *Attorney, Agent, or Firm*—Marshall, O'Toole, Gerstein, Murray & Borun

(57) ABSTRACT

Fluorescent lighting tubes which incorporate an electronic ballast housed in the sleeves or sockets at each end of the lighting tube. The sockets electrically connect the pins at each end of the fluorescent tube to one another and contain a plurality of electrical contacts. A wiring harness is provided which connects the electrical contacts in one sleeve to electrical contacts in the other sleeve.

12 Claims, 1 Drawing Sheet

A
A

STRAIGHT FLUORESCENT TUBE THAT HAS AN ELECTRONIC BALLAST HOUSED IN THE SOCKETS ON BOTH SIDES

BACKGROUND OF THE INVENTION

The type of lighting that is most widespread worldwide is the straight fluorescent tube that has sockets on both sides, as can be found today in all offices, factories, hospitals, etc. Although in the course of the last ten years it has been determined that the operation of these gas discharge lamps—which use simple chokes that are required in order to limit the current of the gas discharge—is not the optimum solution, uncounted millions of lamps of this type are being used.

The disadvantages of straight fluorescent tubes is that in operating lamps at the customary power frequency of 50 or 60 Hz, the light flickers at this frequency and stroboscopic effects can occur, which, for example, cause running machines to look as though they are stopped. Also, the efficiency of the chokes as "inductive" ballasts is not satisfactory. The efficiency of the physical conversion of the at first invisible gas discharge into visible light can be considerably improved by a modern electronic device operating at high frequency. For equivalent light efficiency, a significant energy savings can be obtained in the process, which is not only a significant cost improvement, but also an obligation relative to the environment.

Of course the conversion of inductive lighting units to electronic high frequency operation is not only a question of the material costs of a ballast, but also the expense in installation work associated with installing such apparatus.

Quite often this latter factor prevents a technically and economically advisable conversion.

SUMMARY OF THE INVENTION

The purpose of the present invention is to provide a simple and cost-effective solution which makes possible the conversion to electronic high-frequency operation in a manner that is quick and without excessive installation work.

This purpose is achieved in the present invention by housing all of the structural components of an electronic ballast in one socket, or distributing these elements in two sockets located, respectively, at the right-hand and left-hand end of the fluorescent tube. The necessary electrical connections which are required for the operation of the fluorescent tubes are provided by wires linking the right-hand socket to the left-hand socket.

The electric connections are functionally provided so that they can be plugged into both sockets, in order to allow a simple mounting. This is done to the greatest extent possible using a line channel, which according to the invention can also be simultaneously constructed as a reflector.

Respectively allocated to the two pins of the socket of conventional fluorescent tubes are a connection to the power network and a connection to the starter. During electronic operation, a starter is not necessary. However, since ascertaining the allocation of the pins is not immediately apparent, it is provided according to the invention, to short circuit the two pins in the sockets. Of course, a starter that might already be present in the circuit must be removed.

The sockets proposed for use in the present invention are adapted to fit around the ends of the fluorescent tube. In order to achieve an exchanging capability, the entire length of the fluorescent tubes according to the invention, including the possibly somewhat larger socket, must correspond to the lengths standardized until now.

BRIEF DESCRIPTION OF THE DRAWINGS

The following drawings show examples of the fluorescent lamps according to the invention for the better understanding of the concept of the invention. The drawings are, however, in no way understood to be restrictive, since both the dimensions as well as the shape of the individual parts can be varied in any manner as desired.

DETAILED DESCRIPTION OF A PREFERRED EMBODIMENT

Figures 1, 2, 3, 3A, 4:
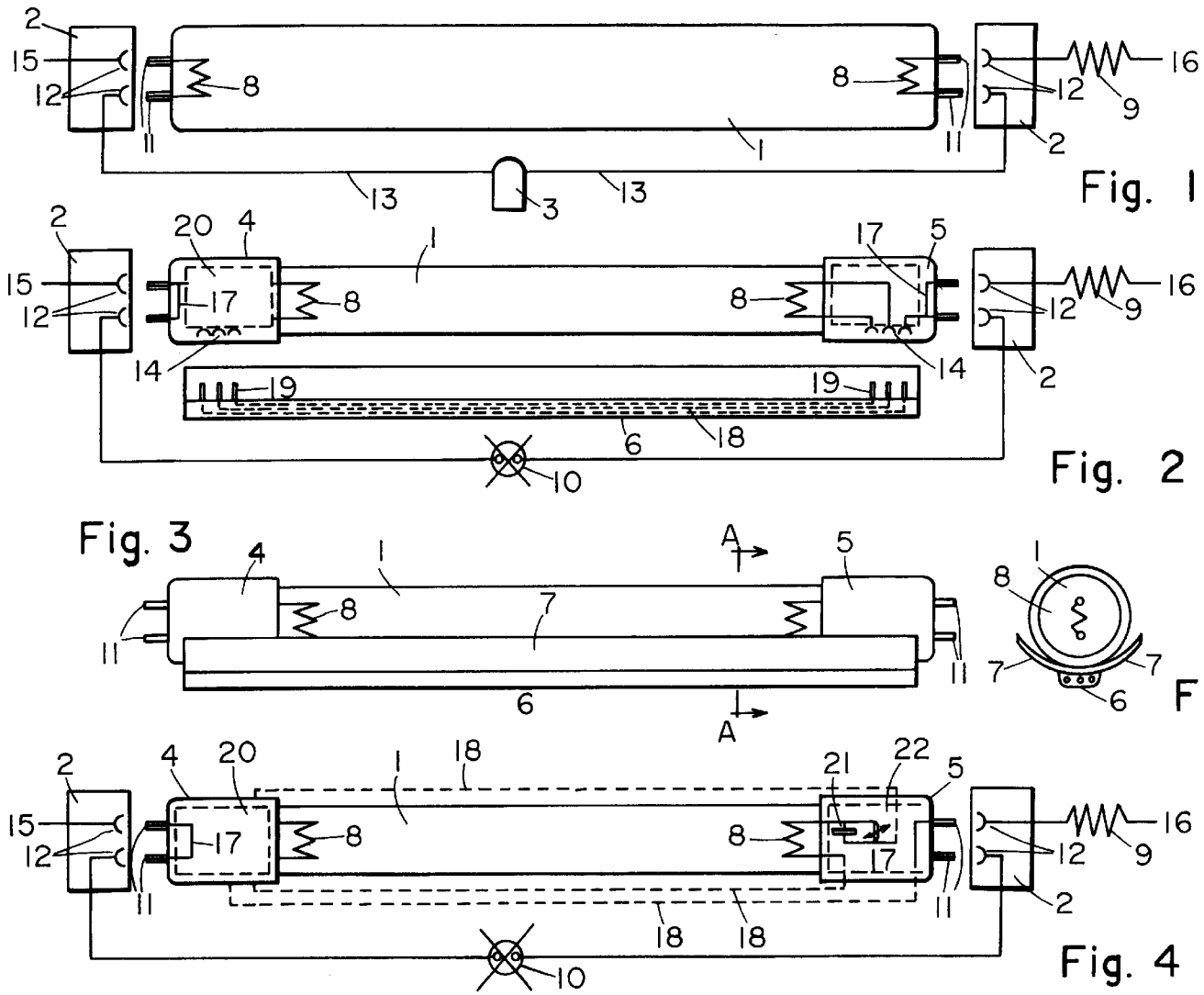
FIG. 1 shows a traditional fluorescent lamp (1) that can be inserted in two brackets (2) with the arrangement of a starter (3).
FIG. 2 shows schematically the arrangement of a fluorescent lamp (1) according to the invention with sockets (4) and (5), into which the required structural components of an electronic ballast or the associated connection components are housed, with an attachable conductor channel (6).
FIG. 3 shows a view of a compact fluorescent lamp (1) according to the invention, having an attachable conductor channel (6) that carries reflector surfaces (7).
FIG. 3*a* shows a section A—A of FIG. 3.
FIG. 4 shows schematically a circuit variation for FIG. 2 in which parts of the electronic ballast are housed in a second socket (5).

The following detailed description explains the concept of the invention and its enormous significance for technical progress. The largest part of the installed long-field lighting units—approximately 90 percent—operate with simple chokes to limit the current of the gas discharge in the fluorescent tubes, with all aforementioned technical and economic disadvantages. A conversion to electronic ballasts progresses only in a very slow manner and is not responsible in terms of cost.

For this, a compact fluorescent lamp according to the invention having an integrated electronic ballast helps completely. The new compact fluorescent tube is inserted without change into the old lighting units and the conversion is readily finished. Only the starter, which is recognized as causing radio interference, must be removed, since it is no longer necessary.

FIG. 1 depicts an arrangement of a conventional fluorescent lamp (1), which is set in two brackets (2) and has a current that is inductively limited by a choke (9), functions for comparison. A so-called "starter" (3) provides that first after a certain pre-heating time of the electrodes (8), a voltage surge causes the ignition of the gas discharge. The fluorescent lamp (1) with its heated electrodes (8) is supplied voltage from the power network (15) or (16) via the spring-finger connectors (12) and the contact pins (11). Also, the starter (3) obtains its connection to the electrodes (8) via the lines (13).

FIG. 2 shows schematically in like manner the simple design of a fluorescent lamp (1) according to the invention, which with its integrated electronic ballast (20) can be described rightly as a compact fluorescent lamp since it unites all essential functional components in a compact construction. On both ends, the sockets (4) and (5), as customary, are each provided with two contact pins (11) to which spring-finger connectors (12) are allocated in the brackets (2).

The necessary electrical connections between the two electrodes which were installed into the lamps until now, are replaced by several connection lines (18), which are functionally housed in a line channel (6) so that they are protected and not visible. Assembly during the manufacturing of this compact fluorescent lamp is made easier in that the line channel (6) is constructed using the connection lines (18) as an attachable structural assembly, having a constructive design that can be permitted within wide limits thanks to the new connection technologies. Each of the connection lines (18) terminates in a plug (19) which mates with connections (14) on sockets (4), (5). The use of plugs that do not have screws, or similar modern processes, instead of the plugs (19) depicted is only mentioned here as an aside.

If it is desirable to insert such a compact fluorescent lamp into an existing lamp, then it is at first not known which spring-finger connectors (14) conduct the supply voltage and which are connected with the lines (13) that lead to the starter. Since the ballast (20) and thus the fluorescent lamp (1) must be supplied with the voltage from the power network (15) and (16), and on the other hand, the starter (3) is no longer necessary, the contact pins (11) on each socket (4) and (5) can be connected by the shorting bars (17) and the starter (3) that is no longer necessary can be removed. For the sake of safety, it is recommended to insert a cover into the starter bracket (10).

If one considers the complicated wiring of a long-field lighting unit and the construction cost associated with it, then this new compact fluorescent lamp is recommended even for new lamps, for which one only has to supply the supply voltage on both ends of the fluorescent lamp. This is a considerable simplification for the lamp industry.

The simple and well-arranged design of a compact fluorescent lamp according to the invention can be ascertained from FIG. 3. In this example, the line channel (6), which preferably is constructed as an extruded plastic tube, is additionally equipped with reflector surfaces (7) that cost practically only the additional material expense and thus, however, can replace an expensive lighting unit in many cases. The section of FIG. 3*a* shows the simple design of a line channel (6) of this type having the side reflector surfaces (7).

The example in FIG. 4 shows that the fundamental concept of the invention can be further constructed, in which a part of the electronic ballast (20) is housed in the socket (5). This involves, for example, an electronic delay circuit that causes the ignition of the gas discharge first after a certain pre-heating of the electrodes in order to reduce the wear of the electrodes and thus to increase the lifetime of the lamps. This function was, in the lamps until now, exercised by the starter (3) that has been mentioned many times. The circuit consists essentially of a small capacitor (21) and a variable temperature PTC-resistance (22).

Moreover, equivalent functional parts having the same reference numbers are provided in the figures. Reference is made again to the fact that the examples depicted are only to be regarded as such and do not describe the scope of the invention in full; however, they give a good overview and suggestions for the application of the concept of the invention.

What is claimed:

1. Straight fluorescent tube that has sockets on both sides, consisting of a straight glass tube as a gas discharge vessel, which is provided on both ends with sockets having contact pins, characterized in that a ballast is housed in one or divided into both sockets and electrical connections are present between the sockets.

2. Straight fluorescent tube that has sockets on both sides according to claim 1, characterized in that the electrical connections between the sockets can be attached to them.

3. Straight fluorescent tube that has sockets on both sides according to claim 1, characterized in that the electrical connections are arranged invisibly hidden in an attachable line channel.

4. Straight fluorescent tube that has sockets on both sides according to claim 3, characterized in that the attachable line channel is constructed as a reflector.

5. Straight fluorescent tube that has sockets on both sides according to claim 1, characterized in that the length of the fluorescent tube, including the socket and the arrangement of the contact pins, is interchangeable and corresponds to the standard lengths of the fluorescent lamp tubes without a ballast.

6. Straight fluorescent tube that has sockets on both sides according to claim 1, characterized in that the two contact pins located on the sockets are short-circuited on both ends of the fluorescent tube.

7. In a straight fluorescent lighting tube having first and second electrical contact pins at left and right-hand ends of said tube, the improvement comprising:

a) first and second electrical sockets mounted to each end of said tube, each said socket containing an electrical circuit comprising:
   i) means for electrically connecting said first contact pin to said second contact pin; and
   ii) a plurality of electrical contacts adapted to mate with connectors on a wiring harness; and b) a wiring harness connecting said right-hand socket to said left-hand socket, said wiring harness having a plurality of electrical connectors at each end for joining the electrical contacts on said right-hand socket to the electrical contacts on said left-hand socket.

8. The lighting tube of claim 7 wherein said wiring harness is mount to a light reflecting element.

9. The lighting tube of claim 7 wherein said sockets comprise tubular sleeves mounted to each end of said lighting tube.

10. The lighting tube of claim 7 wherein a socket contains an electronic ballast.

11. The lighting tube of claim 10 wherein said electronic ballast comprises an electronic delay circuit.

12. The lighting tube of claim 11 wherein said delay circuit comprises a capacitor and an variable temperature PTC-resistance.

* * * * *